US006607101B1

(12) United States Patent
Jones et al.

(10) Patent No.: US 6,607,101 B1
(45) Date of Patent: Aug. 19, 2003

(54) PACKAGING DEVICE FOR PROTECTING A TRIGGER-OPERATED DISPENSER

(75) Inventors: Stuart Michael Ruan Jones, Beverley (GB); Simon Alan Campbell, Hessle (GB)

(73) Assignee: Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 09/936,973

(22) PCT Filed: Mar. 17, 2000

(86) PCT No.: PCT/GB00/00944

§ 371 (c)(1),
(2), (4) Date: Nov. 12, 2001

(87) PCT Pub. No.: WO00/54891

PCT Pub. Date: Sep. 21, 2000

(30) Foreign Application Priority Data

Mar. 18, 1999 (GB) ..... 9906064

(51) Int. Cl.[7] ..... B67B 5/00

(52) U.S. Cl. ..... 222/153.14; 222/153.13; 222/182; 222/192; 222/383.1

(58) Field of Search ..... 222/153.13, 153.14, 222/182, 192, 383.1; 239/333, 493; 229/89, 87.02; 137/377

(56) References Cited

U.S. PATENT DOCUMENTS 4,441,633 A * 4/1984 Bennett ..... 222/153
4,946,074 A * 8/1990 Grogan ..... 222/153
5,156,304 A * 10/1992 Battegazzore ..... 222/341
5,207,359 A * 5/1993 Steijns ..... 222/383
5,441,178 A 8/1995 Wysocki ..... 222/182
5,704,521 A * 1/1998 Grogan et al. ..... 222/383.1
5,823,396 A * 10/1998 Vollmerhaus et al. .. 222/153.13
6,003,738 A * 12/1999 Foster et al. ..... 222/384
6,286,723 B1 * 9/2001 Sweeton et al. ..... 222/153.13

FOREIGN PATENT DOCUMENTS

| | | | |
|---|---|---|---|
| DE | 933 978 | 10/1955 | |
| EP | 0827283 A2 | 3/1998 | ..... H03L/7/12 |
| EP | 0838266 A1 | 4/1998 | ..... B05B/11/00 |
| GB | 1144769 | 3/1969 | |
| GB | 2296700 | 7/1996 | ..... B65D/77/04 |

* cited by examiner

*Primary Examiner*—Gene Mancene
*Assistant Examiner*—Frederick Nicolas
(74) *Attorney, Agent, or Firm*—Fish & Richardson P.C.

(57) ABSTRACT

A packaging device for protecting a trigger-operated sprayer comprising a bottle and a spray gun attachment comprising a trigger, a shroud and a nozzle. The packaging device has a plurality of panels which together define a tube adapted to fit over the tipper part of the sprayer with the lower edge thereof seated on the bottle and to cover the trigger, thereby hindering operation of the sprayer. One of the panels has an opening in which the free end of the trigger engages to hinder operation of the trigger and to hinder removal of the packaging device.

20 Claims, 3 Drawing Sheets

PACKAGING DEVICE FOR PROTECTING A TRIGGER-OPERATED DISPENSER

BACKGROUND OF THE INVENTION

The present invention relates to a packaging device and more specifically to a collarette for use with trigger-operated sprayers. The present invention also relates to a packaging device in combination with a trigger operated sprayer.

Trigger-operated sprayers are used for a wide range of household and garden fluids including cleaning fluids, disinfectants, insecticides, herbicides and the like. Typically the sprayer comprises a bottle which is filled with fluid and a spray gun attachment which is fitted to the open top of the bottle by means of a screw threaded or snap-on arrangement. The spray gun attachment consists of a shroud, a nozzle, a trigger and a tube. The tube extends into the fluid in the bottle and is in fluid communication with the nozzle. The trigger operates a pump mechanism housed within the shroud which draws fluid up the tube and expels it through the nozzle. Usually the nozzle is adjustable between open and closed positions. To make for comfortable operation the neck of the bottle and usually the shroud as well are shaped to provide a hand grip. Other types of trigger operated sprayer may be envisaged and still fall within the scope of the present invention.

For a number of reasons, including to hinder accidental or unauthorised operation of the trigger-operated sprayer, it is increasingly common practice to fit a cardboard collarette over the sprayer for display at the point of purchase. The collarette takes the form of a tube of cardboard which is shaped and dimensioned of fit over the trigger operated sprayer with the lower edge thereof seated on the sides of the bottle. The cardboard collarette covers the trigger thereby hindering it from being either accidentally or deliberately depressed whilst simultaneously displaying on-pack promotions, for example discounts, or extra information on the product contained in the pack.

In order to retain the collarette in place on the trigger-operated sprayer, a portion of the collarette is deformed to fold inwardly so that when the collarette is in position on a trigger-operated sprayer the inwardly deformed portion thereof lies immediately beneath a downwardly facing surface of the shroud or nozzle of the trigger-operated sprayer. This prevents it from slipping off. To facilitate this, crease lines along the deformable portion have to be formed in the blank from which the collarette is made.

Unfortunately, however, the above arrangement does not either hinder tampering or provide evidence of tampering as it is a relatively easy matter to 'un-deform' the inwardly folded portion out and slide the collarette off the trigger-operated sprayer.

Also, the fitting of such a collarette to a trigger operated sprayer is a two-stage labour intensive operation. The collarette must first be slipped over the sprayer and then subsequently deformed to engage underneath a downwardly facing surface of the shroud or nozzle.

It is an object of the present invention to provide a collarette which is more resistant to tampering and removal, is tamper evident, aesthetically pleasing, and which also provides product protection.

It is yet another object of the present invention to provide a collarette which can be fitted over a sprayer in a single step operation.

SUMMARY OF THE INVENTION

According to the present invention there is provided a packaging device for protecting a trigger-operated sprayer comprising a bottle and a spray gun attachment comprising a trigger, a shroud and a nozzle, said packaging device comprising a plurality of panels which together define a tube which is adapted to fit over the upper part of the sprayer with the lower edge of the device seated on the bottle and to cover the trigger thereby hindering operation thereof, wherein one of the said panels has an opening therein in which the free end of the trigger engages to hinder operation of the trigger and removal of the packaging device.

Preferably, the said opening in the panel is in the form of a slot and the lower edge of the slot engages against the underside of the trigger. The slot can be shaped to accommodate the shape of the trigger.

DETAILED DISCLOSURE

Figure 1:
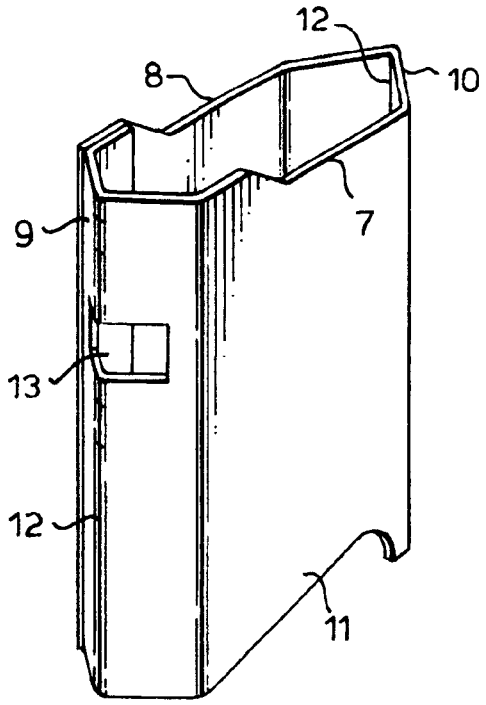
FIG. 1 is a perspective view of an embodiment of a collarette according to the present invention.

In a preferred embodiment of the present invention the collarette is comprised of front and rear panels and two side panels, and the said slot is provided in one of the two side panels. Preferably, a line of weakness extends the length of one or both of the two side panels which facilitates deformation of the collarette to pass over the spray gun attachment and the trigger. It is anticipated that the line of weakness will comprise a fold or crease line. However, the line may comprise perforations to facilitate opening the collarette for removal from the sprayer. It may be convenient with some trigger-operated sprayers to provide more than one line of weakness in each side panel.

Once in position on the trigger-operated sprayer the natural resiliency of the material from which the collarette is fabricated biases it to adopt its original shape or substantially its original shape, thereby ensuring a good fit of the collarette on the sprayer and preventing unauthorised or unintentional removal thereof without damaging the collarette.

Preferably, at least one of the panels of the collarette has an uppermost surface adapted to engage a downwardly facing edge or surface of the shroud and/or nozzle, for example, by being reciprocally shaped to the edge or surface.

Preferably, the collarette is dimensioned such that when in position over the trigger operated sprayer, the uppermost edge of at least one of the panels engages with a downwardly facing edge or surface of the shroud and/or the nozzle. In one embodiment the uppermost edge of one of the two side panels engages with the rear of the shroud and/or the uppermost edge of the other side panel engages with the nozzle. This further improves the resistance of the collarette to tampering and unintentional removal.

The collarette is constructed from a blank comprising a plurality of panels disposed side by side and means for joining the two end panels to form a tube. Preferably, one of the two end panels has a flap along one side which is joined to the other end panel by an adhesive strip. Alternatively, the two end panels may be joined by mating or interlocking tabs. The blank can be fabricated from any sheet material, but typically is manufactured from card, paper or plastics.

Preferably the lowermost edges of each panel of the collarette are so shaped so as to accommodate a shape of the bottle and/or not to obscure any graphics which may be presented on the side of the bottle and/or sprayer.

It will be appreciated that the benefits of the present invention are two-fold. Firstly, by the collarette being resilient and capable of adopting its original shape after deformation, it is a simple matter to fit the collarette to sprayer, the operation merely being a single step with the collarette self-adjusting, to fit snugly on the sprayer. It is of great value that no second separate deformation step is required for at least one portion of the collarette to engage a downwardly facing surface of the sprayer.

Secondly, the more upper surfaces of the panels of the collarette that engage downwardly facing surfaces of the shroud or nozzle, the more difficult it becomes to remove the collarette from the sprayer without damaging the collarette.

Embodiments of the present invention will now be described, by way of example, with reference to the accompanying drawings.

Figure 2:
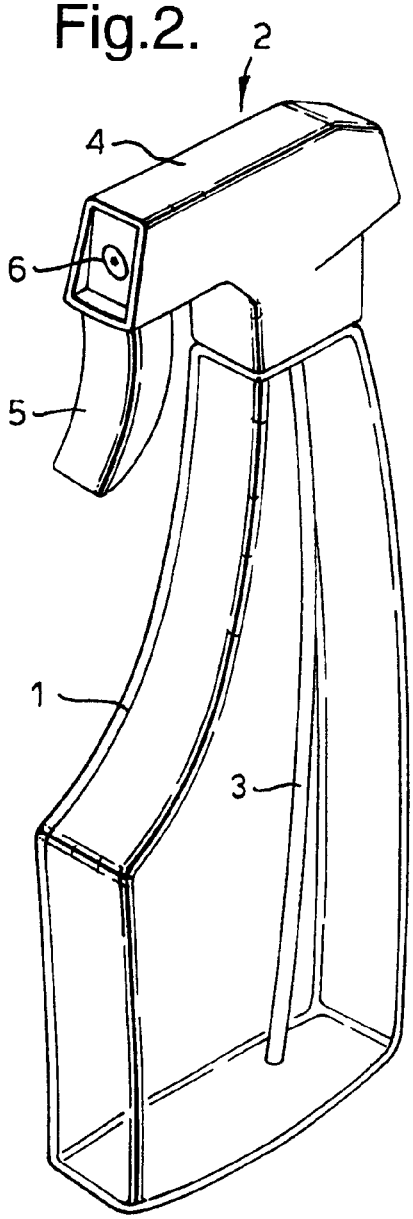
FIG. 2 is a perspective view of a household sprayer for use with the collarette of FIG. 1.

Referring to FIG. 1 of the drawings, there is shown a collarette which is intended in use to fit over the upper part of the trigger-operated sprayer shown in FIG. 2. The collarette can be seen in position over the sprayer in FIG. 3.

The trigger-operated sprayer comprises a bottle 1 which is typically filled with a household cleaning fluid and a spray gun attachment, indicated generally as 2, secured to the top of the bottle 1. The spray gun attachment consists of a tube 3 which can be seen through the clear sides of the bottle 1 extending towards the bottom of the bottle 1, a shroud 4, a trigger 5 and a nozzle 6. The shroud 4 houses a simple pump arrangement (not shown) which is operated by the trigger 5 to draw fluid up the tube 3 and to expel it through the nozzle 6. It will be seen that the upper part of the bottle 1, the rear of the shroud 4 and the trigger are all shaped to facilitate holding the trigger-operated sprayer comfortably in the hand with preferably the index finger on the trigger. It will be apparent from FIG. 3 that the collarette fits over the upper part of the sprayer to cover the trigger 5 and thereby hinder it from being operated.

The collarette takes the form of a four sided open ended tube comprising front and rear panels 7 and 8, and two side panels 9 and 10. The lowermost edges 11 of the front and rear panels 7, 8 are shaped to match labels (not shown) carried on the bottle 1. Each of the side panels 9 and 10 has a crease line 12 in the middle which extends the full length thereof. (It will be appreciated that when the collarette is deformed along the crease lines 12, a six-sided tube is formed as shown in FIG. 1.) Additionally, one of the side panels 9 has an aperture or slot 13 cut in it. The purpose of the crease lines 12 and of the slot 13 will be explained hereinbelow.

Figure 6:
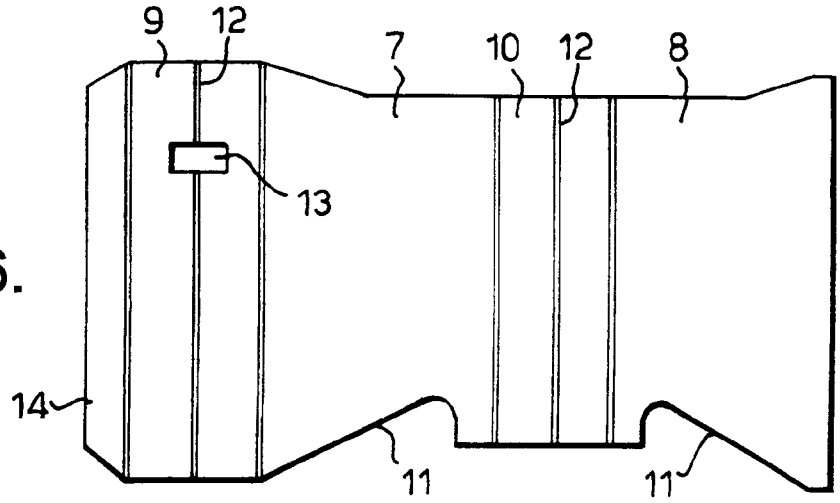
FIGS. 6, 7 and 8 each show a blank for forming a collarette according to the present invention.
Figure 7:
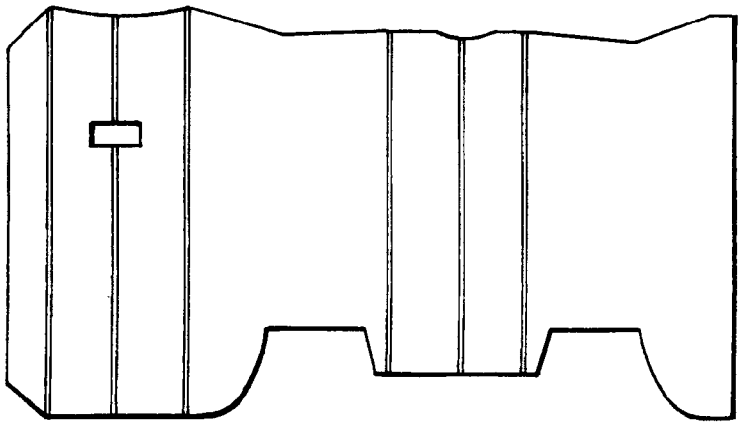
Figure 8:
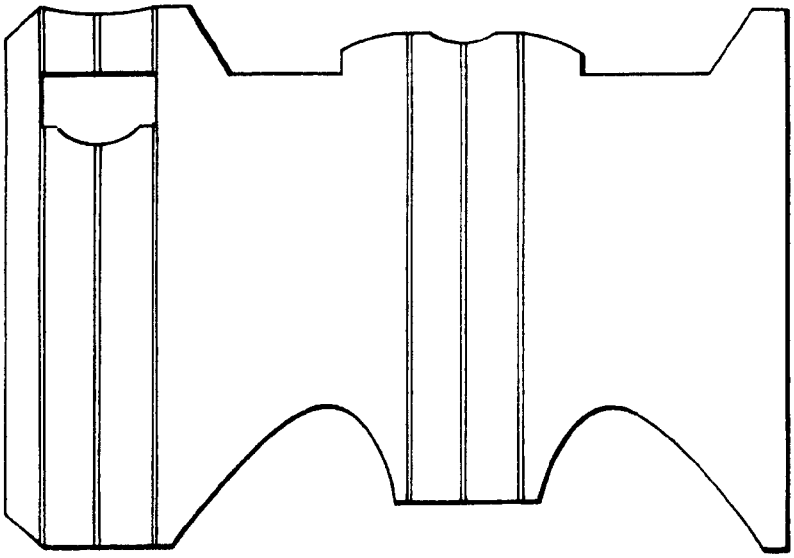

The collarette shown in FIG. 1 is fabricated from the cardboard blank shown in FIG. 6. It will be seen that this comprises a flap 14 down one side of the side panel 9. To complete the collarette, this flap 14 is joined to the free edge of the rear panel 8 by an adhesive strip. Two further blanks for the fabrication of collarettes according to the present invention are shown in FIGS. 7 and 8. These differ from the blank of FIG. 6 in the shape of the front and rear panel 7 and 8, in the upper surfaces of the side panels 9 and 10 and in the shape of the slot 13, but otherwise they are the same.

Figure 3:
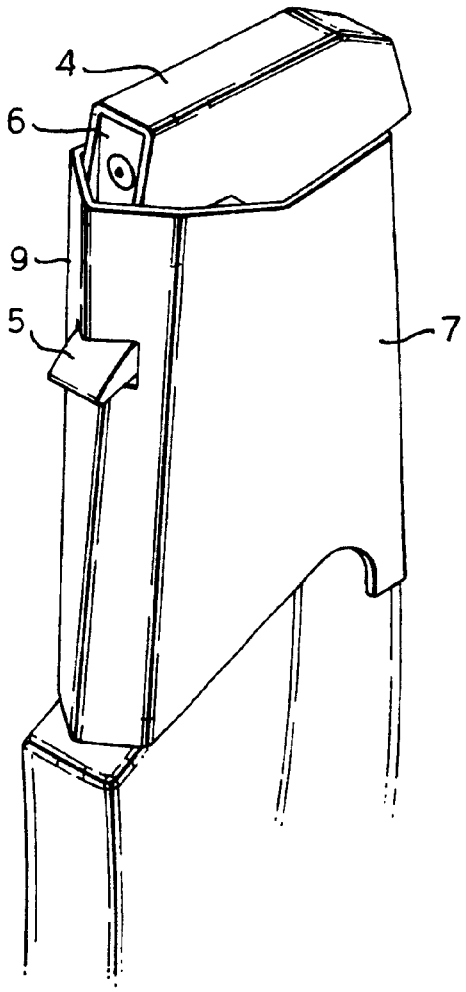
FIG. 3 is a partial perspective view of the collarette of FIG. 1 mounted on the household sprayer of FIG. 2.

The collarette shown in FIG. 1 is fitted onto the sprayer shown in FIG. 2 by sliding it down over the top thereof. The distance between the side panels 9 and 10 is such as to be equal to or preferably slightly less than the maximum distance between the front and rear of the spray gun attachment 2, including the trigger 5. The closeness of the fit between the collarette and the spray gun attachment 2 is accommodated by the crease lines 12 in the side panels 9 and 10. These allow the collarette to deform or "stretch" as it passes over the spray gun attachment. The collarette is in its final position when the trigger 5 is engaged in the slot 13 and the uppermost edge of the side panel 10 lies under the rear of the shroud 4 as shown in FIG. 3. Engagement of the trigger 5 in the slot 13 and of the upper edge of the side panel 10 with the rear of the shroud 4 is facilitated by the natural resiliency of the material from which the collarette is made which biases each of the side panels 9 and 10 to resume its original shape about the crease line 12, thus effectively decreasing the distance between the side panels 9 and 10. It may also be facilitated to some extent by any play in the trigger 5 itself.

It will be understood that once the trigger 5 is engaged in the slot 13 it cannot easily be depressed; the underside of the trigger 5 is supported against the lower edge of the slot 13. Only by crushing the collarette can the trigger 5 be operated. It will also be apparent that the collarette cannot be easily removed once it is in position. Not only must the trigger 5 be disengaged from the slot 13 in the side panel 9, but the uppermost edge of the side panel 10 must be disengaged from under the rear of the shroud 4. This effectively requires the collarette to be "stretched" open. Indeed, it is envisaged that the collarette will usually need to be torn open to remove it.

Figure 4:
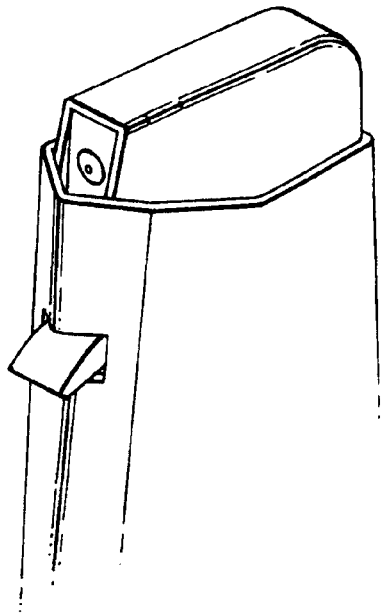
FIG. 4 is a partial perspective view of an embodiment of a collarette according to the present invention fitted to a household sprayer of different design from the one shown in FIG. 2.

Referring to FIG. 4 of the drawings, there is shown a collarette according to the present invention fitted to a sprayer of a different design to the one shown in FIG. 2. Here the shroud of the sprayer does not define a downwardly facing edge or surface at the rear against which the uppermost edge of the side panel can engage. Consequently, the collarette is held in place only by the engagement of the trigger in the slot.

Figure 5:
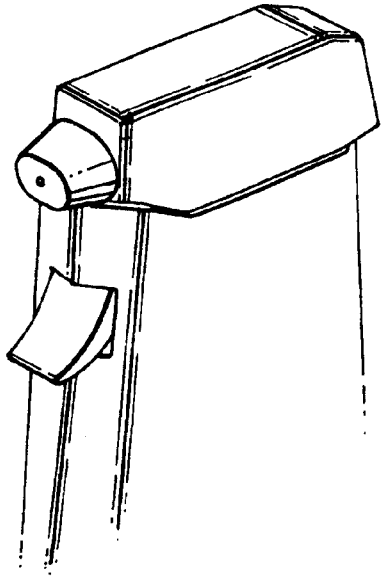
FIG. 5 is a partial perspective view of an embodiment of a collarette according to the present invention fitted to a household sprayer of different design from the ones shown in FIGS. 2 and 4.

Referring to FIG. 5 of the drawings, there is shown a collarette according to the present invention fitted to a sprayer of yet another design to the ones shown in FIGS. 2, 3 and 4. In this case the sprayer defines downwardly facing surfaces at both the front, under the nozzle, and at the rear, under the shroud, and the uppermost edges of both side panels engage against these to further secure the collarette in place.

The design of the collarette according to the present invention is such that it can be slipped into position over the top of a trigger-operated sprayer in a single operation. There are no tabs or corners which must be folded over to secure the collarette in place, as is the case with known collarettes. This makes the collarette according to the present invention ideally suited to both machine fitting and hand application. In either instance, the fitment of the collarette is easy and quick to apply resulting in substantial cost benefits.

We claim:

1. A packaging device for protecting a trigger-operated sprayer comprising a bottle and a spray gun attachment having a trigger that has a free end, a shroud and a nozzle said bottle having an upper part shaped so as to facilitate manual holding of the bottle, shroud and trigger, said packaging device comprising a plurality of panels which together define a tube having upper and lower edges and adapted to fit over the upper part of the sprayer with the lower edge of said tube seated on the bottle and covering the trigger, thereby hindering operation thereof, wherein one of said panels has an opening in which the free end of the trigger engages in order to hinder operation of the trigger and to hinder removal of the packaging device.

2. The packaging device according to claim 1, wherein the opening in the panel is a slot having a lower edge adapted to engage against the underside of the trigger.

3. The packaging device according to claim 2 wherein the slot is shaped to accommodate the shape of the trigger.

4. The packaging device according to claim 2 or 3 which is comprised of front and rear panels and two side panels, and the slot is provided in one of the two side panels.

5. The packaging device according to claim 4 wherein at least one line of weakness extends for the length of one or both of the two side panels, thereby facilitating deformation of said packaging device so that it can pass over the spray gun attachment and the trigger.

6. The packaging device according to claim 6 wherein the line of weakness comprises a fold or a crease line.

7. The packaging device according to claim 5 wherein the line of weakness comprises perforations.

8. The packaging device according to claim 5 which is biased to adopt its original shape after deformation.

9. The packaging device according to claim 8 wherein a line of weakness comprises a fold or a crease line.

10. The packaging device according to claim 8 wherein a line of weakness comprises perforations.

11. The packaging device according to claim 2 or 3 wherein at least one of the panels has an uppermost surface adapted to engage a downwardly facing edge or surface of the shroud and/or nozzle of the sprayer.

12. The packaging device according to claim 11 which is comprised of front and rear panels and two side panels and the slot is accomodated in one of said side panels, and wherein at least one line of weakness extends the length of one or both of said two side panels, thereby facilitating deformation of the packaging device so that it can pass over the spay gun attachment and the trigger.

13. The packaging device according to claim 12 wherein the line of weakness comprises a fold or crease line.

14. The packaging device according to claim 12 wherein the line of weakness comprises perforations.

15. In combination: a trigger-operated sprayer comprising a bottle and a spray gun attachment having a trigger that has a free end, a shroud and a nozzle, said bottle having an upper part shaped so as to facilitate manual holding of the bottle shroud and trigger; and a packaging device for protecting said sprayer, said packaging device comprising a plurality of panels which together define a tube having upper and lower edges and adapted to fit over the upper part of the sprayer with the lower edge of said tube seated on the bottle and covering the trigger, thereby hindering operation thereof, wherein one of said panels has an opening in which the free end of the trigger engages in order to hinder operation of the trigger and to hinder removal of the packaging device.

16. The combination of claim 15 in which the packaging device is comprised of front and rear panels and two side panels and the opening, in the form of a slot which is adapted to engage against the underside of the trigger, is provided in one of said side panels.

17. The combination of claim 16 wherein one line of weakness, in the form of a fold, a crease line or perforations, extends the length of one or both of the two side panels, thereby facilitating deformation of the packaging device so that it can pass over the spray gun attachment and the trigger.

18. The combination of claim 17 wherein the packaging device is biased to adopt its original shape after deformation.

19. The combination of claims 17 or 18 wherein at least one of the panels comprising the packaging device has an uppermost edge that engages with a downwardly facing edge or surface of the shroud and/or nozzle of the sprayer.

20. The combination of claim 19 wherein the uppermost edge of the panel engages with the rear of the shroud and/or the uppermost edge of another panel engages with the nozzle.

* * * * *